US005311653A

United States Patent [19]

Merrick

[11] Patent Number: 5,311,653

[45] Date of Patent: May 17, 1994

[54] WEB ADJUSTER FOR PLASTIC COATED WEB

[75] Inventor: David D. Merrick, Indianapolis, Ind.

[73] Assignee: Indiana Mills & Manufacturing, Inc., Westfield, Ind.

[21] Appl. No.: 29,671

[22] Filed: Mar. 11, 1993

[51] Int. Cl.[5] ..... A44B 11/00

[52] U.S. Cl. ..... 24/196; 24/171

[58] Field of Search ..... 24/196, 171, 170, 68 C, 24/68 D

[56] References Cited

U.S. PATENT DOCUMENTS

| | | | |
|---|---|---|---|
| 2,919,481 | 1/1960 | Finken et al. | 24/196 |
| 2,938,254 | 5/1960 | Gaylord | 24/171 |
| 3,293,713 | 12/1966 | Gaylord | 24/196 |
| 3,414,947 | 12/1968 | Holmberg et al. | 24/196 |
| 3,898,715 | 8/1975 | Balder | 24/196 |
| 4,184,234 | 1/1980 | Atnhony et al. . | |
| 4,876,770 | 10/1989 | Bougher . | |

FOREIGN PATENT DOCUMENTS

| | | | |
|---|---|---|---|
| 1195990 | 7/1965 | Fed. Rep. of Germany | 24/196 |

*Primary Examiner*—Victor N. Sakran

*Attorney, Agent, or Firm*—Woodward, Emhardt, Naughton, Moriarty & McNett

[57] ABSTRACT

A web adjuster for use with a plastic coated web. An adjuster frame includes a pair of slotted upstanding walls which slidably receive a roller bar extending therebetween. A plastic sleeve is rotatably mounted to the bar and includes a plurality of flexible ribs. The web extends around the sleeve which acts as a bearing relative to the bar. A stop edge is contactable by the web as the bar and sleeve move thereto locking the web to the adjuster.

18 Claims, 2 Drawing Sheets

WEB ADJUSTER FOR PLASTIC COATED WEB

BACKGROUND OF THE INVENTION

1. Field of the Invention

This invention is in the field of clamps for adjustably holding a web to secure a person or other object.

2. Description of the Prior Art

Seat belt buckles and tongues are attached to webs having their opposite ends fixedly mounted to a frame. In order to allow use by different size occupants, the web is adjustably movable with respect to either the buckle or tongue. This is typically accomplished by providing a movably mounted bar on the buckle and/or tongue with the web then moving around the bar. A web stop formed on the buckle and/or tongue and extending the length of the bar prevents relative motion between the web and the bar when the bar is forced against the web stop. Such devices are disclosed in the U.S. Pat. Nos. 4,184,234 and 4,876,770 both assigned to Indiana Mills & Manufacturing, Inc.

Web clamps or adjusters as disclosed in the in aforementioned patents may be used to secure a variety of objects. For example, it is the custom to provide webs or belts on a stretcher with the web then extending over the patient to prevent the patient from falling from the stretcher. In such a case, a web adjuster may be utilized to allow for the rapid locking and unlocking of the web. In the event the patient's body fluids contact the stretcher and components including the web, then the same must be cleansed and disinfected before reuse. As a result, the web utilized is provided with a plastic coating to facilitate the cleansing thereof.

The prior art web adjusters include a metal or steel bar around which is wrapped the belt or web. In the case of a plastic coated web, the web will immediately grip the steel adjuster bar once the web contacts the bar preventing easy and rapid loosening or relative motion between the web and bar. A further problem is the relative stiffness of such a plastic coated web increasing the difficulty of bending the web through an angle of approximately 180° as the web is loosened relative to the bar. Disclosed herein is a new web adjuster which alleviates both of these problems.

SUMMARY OF THE INVENTION

One embodiment of the present invention is a web adjuster comprising a frame with a pair of spaced apart slots and having a web stop extending across the frame, a bar with opposite ends slidably mounted in slots to receive a web extending at least partially around the bar with the bar movable in slots with the web to and from a web stop; and a first device mounted on the bar and located between the bar and the web operable to position the web apart from the bar allowing relative motion between the web and the bar when the web is positioned apart from the web stop and further operable under web pressure to allow contact between the web and the bar to limit relative motion between the web and the bar as the bar forces the web against the web stop.

Another embodiment of the present invention is a frame with a pair of upstanding walls with a pair of spaced apart slots formed therein, a bar extending between the upstanding walls and having opposite ends slidably mounted in slots, a web extending at least partially around the bar, and a separator mounted on the bar and located between the bar and the web to separate the web apart from the bar allowing the web to move relative to the bar. The separator is movable on the bar to allow contact between the web and the bar to limit relative motion between the web and the bar.

In is an object of the present invention to provide a new and improved web adjuster.

A further object of the present invention is to provide a web adjuster usable with a plastic coated web.

An additional object of the present invention is to provide a web adjuster having means spacing apart the web and adjuster bar but movable to allow gripping contact therebetween upon exertion of web pressure.

Related objects and advantages of the present invention will be apparent in the following description.

DESCRIPTION OF THE PREFERRED EMBODIMENTS

Figure 1:
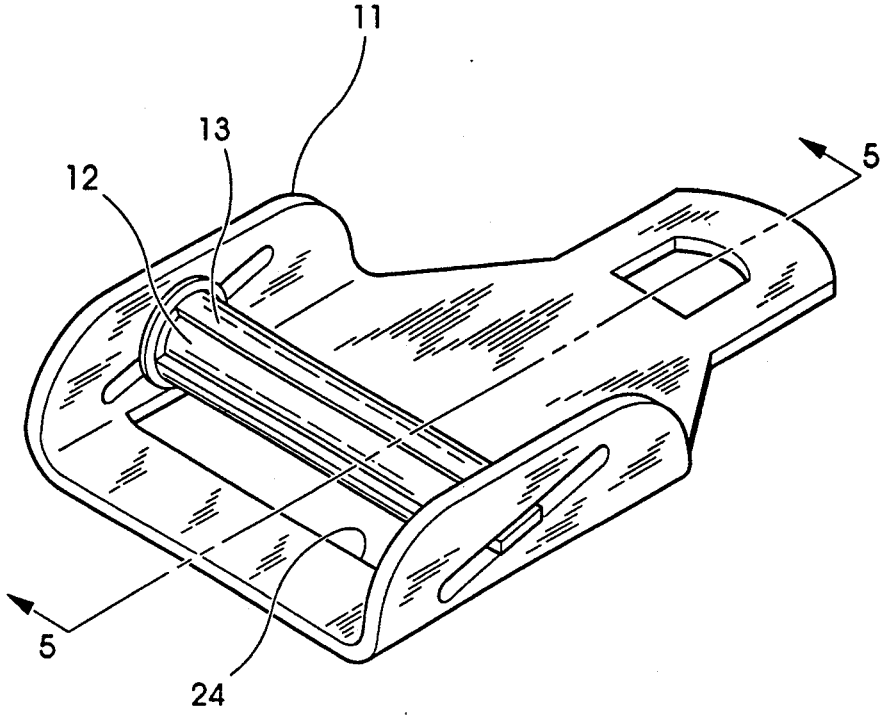
FIG. 1 is a perspective view of the preferred embodiment of the web adjuster incorporating the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to the drawings, there is shown an adjuster-web combination 10 which includes adjuster frame 11, adjuster bar 12, sleeve 13, and web 14. The preferred embodiment of combination 10 has the bar 12, sleeve 13 and web 14 mounted to adjuster frame 11 whereas the alternate embodiment of the web-adjuster combination 10 has bar 12, sleeve 13 and web 14 mounted to adjuster frame 15.

Frame 11 includes a base 16 with a pair of upstanding walls 17 and 18 integrally attached thereto. A conventional seat belt tongue 19 with locking pawl aperture 20 in integrally connected to and extends outwardly from base 16. A pair of spaced apart slots 21 and 22 are formed respectively in upstanding walls 17 and 18. An opening 23 is provided in base 16 immediately beneath slots 21 and 22 forming a pair of parallel edges 24 and 25 extending between walls 17 and 18. Edge 24 provides a stop means or stop surface contactable by the web as explained later in the specification. Slots 21 and 22 are inclined and extend in a direction away from the base as the slots extend in a direction from edge 24 to edge 25. That is, ends 26 and 27 of slots 21 and 22 are located closer to edge 24 as compared to the positioning of ends 28 and 29 of the slots relative to edge 25.

The adjuster bar 12 is solid and has a cylindrical outer surface 30. A pair of flat ears 31 and 32 are integrally attached to and extend outwardly from the opposite ends of bar 12 with the longitudinal central axis 33 of the bar extending through the ears. Ears 31 and 32 are sized to fit within slots 21 and 22 thereby slidably mounting the bar to frame 11 and allowing the bar to move to and from stop edge 24.

Sleeve 13 has a pair of disc shaped opposite ends 34 and 35 integrally attached to the opposite ends of separator ribs 36, 37 and 38. The sleeve depicted in the drawing is shown as having only three such separator ribs; however, the number of separator ribs may be varied. Ends 34 and 35 include holes 39 and 40 extending therethrough which are slightly greater than the outside diameter of bar 12 allowing the sleeve to be rotatably mounted onto the bar. That is, bar 12 may be inserted into sleeve 13 when the longitudinal central axes 33 and 41 are aligned. Once sleeve 13 is mounted to bar 12, the resultant assembly is then mounted to frame 11 by positioning ears 31 and 32 into slots 21 and 22. The longitudinal distance along axis 41 from end 34 to end 35 of the sleeve is slightly less than the length of bar 12 excluding ears 31 and 32 thereby positioning sleeve ends 34 and 35 inwardly of the mutually facing surfaces of upstanding walls 17 and 18. The inside diameter of sleeve 13 defined by holes 39 and 40 as well as the inwardly facing surfaces of ribs 36–38 is slightly greater than the outside diameter of bar thereby allowing the sleeve to freely rotate about axis 41 on bar 12. In one embodiment, sleeve 13 is produced from a plastic material such as Delrin, whereas bar 12 is produced from heat treated steel, The main body of web 14 is a fabric material coated or encapsulated by a plastic, such as, urethane. Such a urethane coated web is relatively stiff and will grip the outer surface 30 of bar 12 in the event the web contacts the bar. Thus, in order to allow the web to be adjusted relative to bar 12, the web is extended at least partially around sleeve 13 and bar 12 resting on the outwardly facing surfaces of ribs 36–38. Since the sleeve is freely rotatable on the bar, the sleeve acts as a rotatable bearing allowing for relative motion between the web and bar. In the embodiment shown in FIG. 5, end 40 of web 14 is fixedly attached to the item upon which the web is to be secured. For example, end 40 of the web may be attached to a stretcher frame. The web is then extended beneath base 16 and upwardly through opening 23 in a counterclockwise direction as viewed in FIG. 5 and at least partially around the sleeve and bar passing back through opening 23 near stop edge or surface 24 with the free end 41 of the web positioned over the main body of the web allowing the user to grasp and pull end 41 into the direction of arrow 42 to tighten the adjuster.

Figure 5:
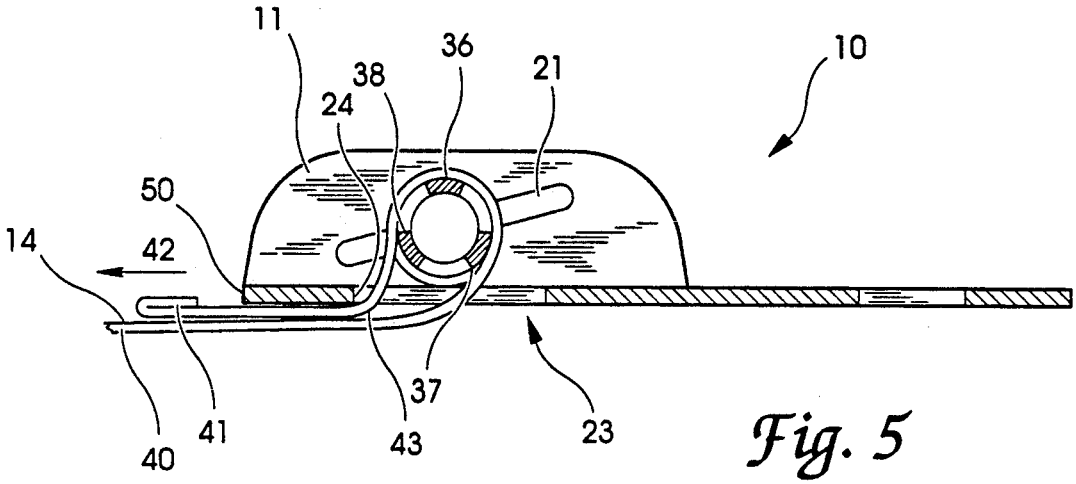
FIG. 5 is cross sectional view taken along the line 5—5 of FIG. 1 and viewed in the direction of the arrows showing the web extending around the sleeve and adjuster bar.

Ribs 36–38 are depicted in the preferred embodiment in FIG. 5 as being located at each 120° interval around the axis 33 of bar 12. For example, separators 36 and 37 are defined by an included angle of 120° and therefore are normally spaced apart a fixed distance. Each rib extends in a parallel direction to the bar axis 33 having the rib opposite ends fixed to disc shaped ends 34 and 35. Each rib has a sufficient length and is flexible allowing the central portion of the rib located equidistant between disc shaped ends 34 and 35 to flex and move as web pressure is applied to the rib. As a result, increased web pressure causes the ribs in contact with the web to flex and move increasing the normal space between adjacent ribs providing a vacated space between the ribs and allowing the web to contact bar 12. The plastic coating on the web causes immediate gripping between the web and bar when the web extends between adjacent ribs preventing further rotation of sleeve 13 and causing the sleeve and bar to move downwardly in slots 21 and 22 positioning the web portion 43 against stop 24 thereby locking the adjuster to the web.

In operation, tongue 19 is lockingly engaged with a buckle attached to a second web. End 41 is then grasped and pulled in the direction of arrow 42. In the event slack exists in web 14 then sleeve 13 will rotate in a counterclockwise direction as viewed in FIG. 5 while maintaining the complete separation of the web from bar 12. Eventually, further movement of web end 41 in the direction of arrow 42 will result in web pressure applied to those ribs in contact with the web. In the case of the sleeve as positioned in FIG. 5, maximum web pressure will be applied to rib 36 causing the central portion of rib 36, that is, the center portion of the rib located equidistant between ends 34 and 35 to move further counterclockwise increasing the distance between the central portion of ribs 36 and 37 and allowing the web to contact bar 12 in the space between ribs 36 and 37 thereby preventing further rotation of sleeve 13. As the web is further tightened, the web by gripping bar 12 between ribs 36 and 37 will cause the sleeve and bar to move downwardly in slots 21 and 22 causing the web to serpentine around stop 24 positioning portion 43 of the web adjacent stop 24 locking the web to the adjuster.

Sleeve 13 provides a means mounted to bar 12 located between the bar and web which is first operable to position the web apart from the bar allowing relative motion between the web and bar when the web is slack and positioned apart from web stop 24. Sleeve 13 thereby provides a bearing upon which a web may move when in the slack condition. The ribs of the sleeve are normally spaced apart a first distance but are flexible under web pressure to decrease this distance between at least two of the ribs to allow the web to contact the bar therebetween limiting motion between the web and the bar. The sleeve is therefore also operable, under web pressure, to allow contact between the web and the bar limiting relative motion between the web and the bar as the bar moves downwardly in the slots forcing the web against web stop 24.

Figure 2:
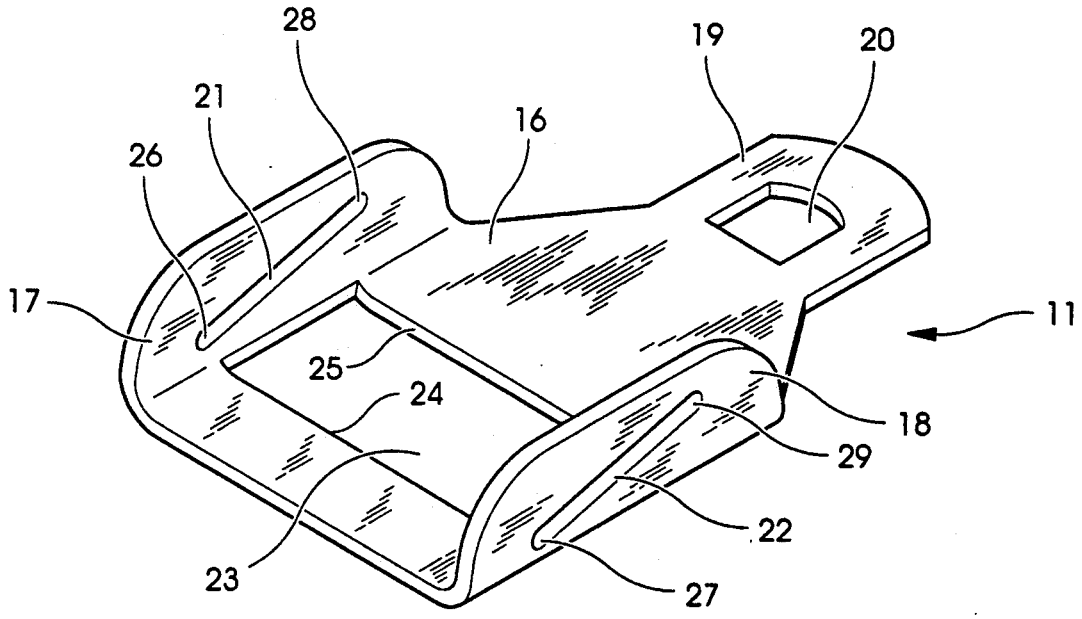
FIG. 2 is a perspective view of the frame of the adjuster of FIG. 1.
Figure 3:
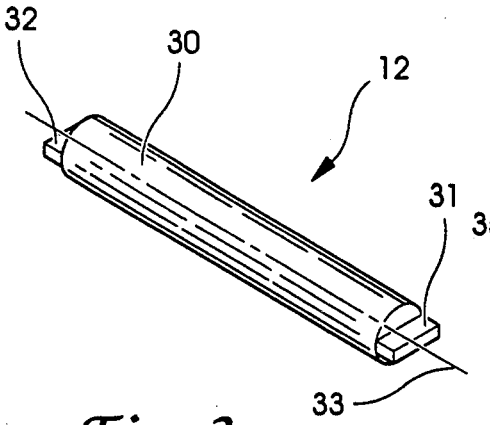
FIG. 3 is a perspective view of the adjuster bar for slidably mounting to the frame of FIG. 2.
Figure 4:
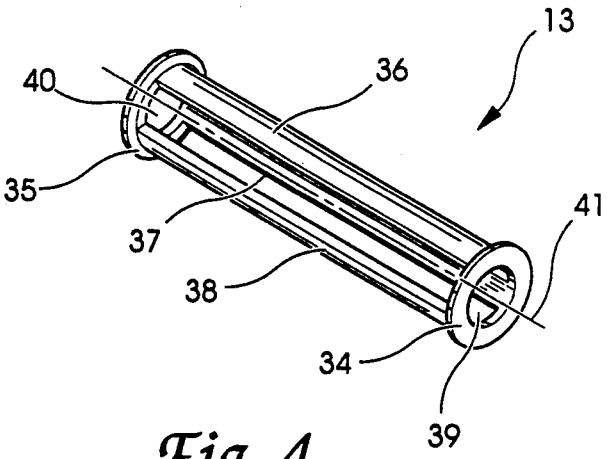
FIG. 4 is a perspective view of the sleeve rotatably mountable to the bar of FIG. 3.
Figure 6:
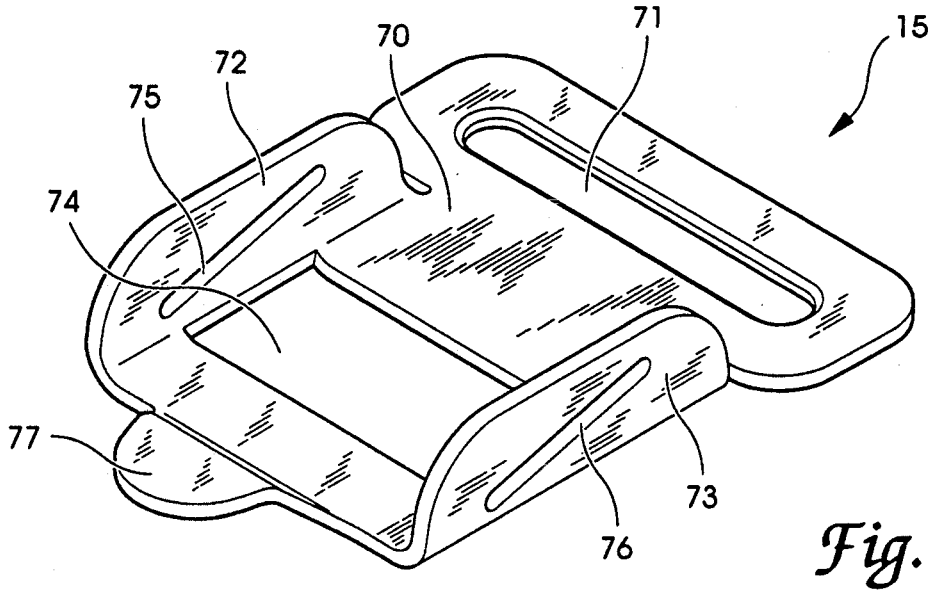
FIG. 6 is a perspective view of an alternate embodiment of the adjuster frame.

Stop 24 provides a stop surface which extends perpendicularly to and between the upstanding walls 17 and 18. The web stop engages the web when the web is taut and extending in the direction of arrow 42 which is parallel and in an opposite direction to the direction tongue 19 extends from base 16. By positioning web 14 perpendicular to base 16, web portion 43 is moved apart from stop 24 thereby unlocking the web from the adjuster and again allowing the sleeve to rotate. Thus, in order unlock the web from the adjuster shown in FIG. 5, end 50 of frame 11 may be grasped and pulled upwardly to rotate frame 11 about the longitudinal axis of bar 12 while maintaining the position of web 14 until the web is perpendicularly arranged relative to the bottom surface of the base 16 of frame 11. In an alternate embodiment depicted in FIG. 6, a handle 77 is provided for the specific purpose of grasping and pivoting the frame. Frame 15 is identical to frame 11 with the exception tongue 19 is replaced with a flange having an aperture 71 extending therethrough enabling a second web to be extended through the aperture. Frame 15 includes a pair of upstanding walls 72 and 73 integrally attached to the base having a pair of slots 75 and 76 extending downwardly to the rear stop edge formed by opening 74 in a manner identical to that shown for the frame of FIG. 2. Handle 77 is integrally attached and extends rearwardly from the base. A bar and sleeve identical to that shown in FIGS. 3 and 4 are mounted to frame 15 and web 14 is extended around the sleeve and bar and extended rearwardly beneath handle 77 in an identical manner as shown in FIG. 5. Handle 77 may therefore be used to move frame 15 skewedly relative to the web 14 until the web is no longer parallel to the frame moving the web apart from the stop edge and allowing the web to be rotated along with sleeve 13 on bar 12.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A web adjuster comprising:

a frame with a pair of spaced apart slots and having a web stop extending across said frame;

a bar with opposite ends slidably mounted in said slots to receive a web extending at least partially around said bar, said bar movable in said slots with said web to and from said web stop; and, first means mounted on said bar and located between said bar and said web operable to position said web apart from said bar allowing relative motion between said web and said bar when said web is positioned apart from said web stop and further operable under web pressure to allow contact between said web and said bar to limit relative motion between said web and said bar as said bar forces said web against said web stop.

2. The web adjuster of claim 1 wherein:

said means is movably mounted to said bar providing a bearing on said bar upon which said web may move relative to said bar.

3. The web adjuster of claim 1 wherein:

said means includes a plurality of separators extending across said bar and normally having a first spacing between separators when said web is spaced apart from said bar, said separators movable under web pressure to increase said first spacing between at least two such separators allowing contact between said web and said bar limiting relative motion between said web and said bar.

4. The web adjuster of claim 3 wherein:

said means is movably mounted to said bar providing a bearing on said bar upon which said web may move relative to said bar.

5. The web adjuster of claim 3 wherein:

said bar is cylindrical;

said means includes a sleeve freely rotatably on said bar which extends therethrough, said sleeve has a longitudinal axis of rotation with a plurality of slots extending in the direction of said axis, said slots each has a width which is said first spacing with said separators located between said slots.

6. The web adjuster of claim 5 and further comprising:

a buckle tongue extending outwardly from said frame oppositely of said web.

7. The web adjuster of claim 5 and further comprising:

handle means extending from said frame operable when moved to move said frame skewedly relative to said web moving said web apart from said web stop and allowing relative motion between said web and said bar.

8. A web adjuster comprising:

a frame with a pair of upstanding walls with a pair of spaced apart slots formed therein;

a bar extending between said upstanding walls and having opposite ends slidably mounted in said slots for a web to extend at least partially around said bar; and, a separator mounted on said bar and located between said bar and said web to separate said web apart from said bar allowing said web to move relative to said bar, said separator is immovable on said bar to allow contact between said web and said bar to limit relative motion between said web and said bar.

9. The web adjuster of claim 8 wherein:

said separator includes a plurality of ribs normally spaced apart a first distance holding said web apart from said bar, said ribs are flexible under web pressure to decrease said first distance between at least two of said ribs to allow said web to contact said bar limiting motion between said web and said bar.

10. The web adjuster of claim 9 wherein:

said separator is a sleeve movably mounted on said bar which extends therethrough, said sleeve has said ribs formed thereon with slots formed between said ribs through which said web may contact said bar under sufficient web pressure.

11. The web adjuster of claim 10 and further comprising:

a buckle tongue extending outwardly from said frame.

12. A web adjuster comprising:

a frame with a pair of upstanding walls with a pair of spaced apart slots formed therein;

a bar extending between said upstanding walls and having opposite ends slidably mounted in said slots;

a web extending at least partially around said bar; and, separator means mounted on said bar and located between said bar and said web to separate said web apart from said bar allowing said web to move relative to said bar, said separator means is movable on said bar to allow contact between said web and said bar to limit relative motion between said web and said bar.

13. The web adjuster of claim 12 wherein:

said web is plastic encapsulated to facilitate cleansing thereof.

14. The web adjuster of claim 12 wherein:

said separator means is operable to rotatable move on said bar to carry said web allowing relative motion between said bar and said web and is further operable to move under web pressure to provide a vacated space between said web and said bar allowing web contact with said bar limiting relative motion therebetween.

15. The web adjuster of claim 14 wherein:

said frame includes a base extending between and connected to said upstanding wall, said base includes a stop surface extending perpendicularly to and between said upstanding walls.

16. The web adjuster of claim 15 wherein:

said separator means includes a cylindrical sleeve rotatably mounted on said bar which extends therethrough, said sleeve includes a pair of disc shaped opposite ends located inwardly and adjacent said upstanding walls and further includes a plurality of spaced apart flexible ribs extending between said disc shaped ends, said ribs normally separating said web apart from said bar but movable further apart under web pressure as said bar forces said web against said stop surface.

17. The web adjuster of claim 16 wherein:

said separator means is operable to allow said sleeve to rotate on said bar when said web is perpendicularly positioned relative to said base and is further operable to allow said sleeve with bar to move toward said stop surface under web pressure when said web is positioned to extend in the general direction of said base.

18. The web adjuster of claim 17 and further comprising:

handle means extending from said frame operable when moved to move said base skewedly relative to said web moving said web apart from said stop surface and allowing relative motion between said web and said bar.

* * * * *

UNITED STATES PATENT AND TRADEMARK OFFICE

CERTIFICATE OF CORRECTION

PATENT NO. : 5,311,653

DATED : May 17, 1994

INVENTOR(S) : David D. Merrick

It is certified that error appears in the above-identified patent and that said Letters Patent is hereby corrected as shown below:

Column 6, line 20 delete "immovable" and insert --movable--.

Signed and Sealed this

Twenty-second Day of November, 1994

*Attest:*

*Attesting Officer*

Bruce Lehman

BRUCE LEHMAN

*Commissioner of Patents and Trademarks*